US007169068B1

(12) United States Patent
Marangoni

(10) Patent No.: US 7,169,068 B1
(45) Date of Patent: Jan. 30, 2007

(54) RACQUET-STRING ALIGNMENT PICK

(76) Inventor: Steve Marangoni, 16 Buckskin La., Riverhead, NY (US) 11901

( * ) Notice: Subject to any disclaimer, the term of this patent is extended or adjusted under 35 U.S.C. 154(b) by 0 days.

(21) Appl. No.: 11/201,692

(22) Filed: Aug. 11, 2005

(51) Int. Cl.
*A63B 49/00* (2006.01)

(52) U.S. Cl. ..... 473/553

(58) Field of Classification Search ..... 473/553, 473/557; 206/537; D21/729, 799.1
See application file for complete search history.

(56) References Cited

U.S. PATENT DOCUMENTS

| | | | | |
|---|---|---|---|---|
| 3,299,898 | A * | 1/1967 | Payne | 131/246 |
| 3,930,509 | A * | 1/1976 | Zysset | 131/246 |
| 3,968,902 | A | 7/1976 | Bachmann | |
| 4,089,523 | A | 5/1978 | Newburger | |
| 4,336,882 | A | 6/1982 | Sakwa | |
| 4,444,211 | A * | 4/1984 | MacDonald | 131/246 |
| 4,465,191 | A | 8/1984 | Darbo | |
| 4,733,866 | A | 3/1988 | Herbert | |
| 4,752,071 | A | 6/1988 | Tabach | |
| 4,776,591 | A | 10/1988 | Ho | |
| 5,035,429 | A | 7/1991 | Redrow | |
| 5,050,053 | A | 9/1991 | McDermott | |
| 5,207,423 | A | 5/1993 | Short | |
| 5,310,181 | A | 5/1994 | Chan | |
| 5,368,406 | A | 11/1994 | Hanshaw | |
| 5,441,258 | A | 8/1995 | Pagan | |
| 5,653,441 | A | 8/1997 | Woltanski | |
| 5,823,900 | A | 10/1998 | Harren | |
| 6,030,298 | A | 2/2000 | Tate | |
| 6,413,173 | B1 | 7/2002 | Muller et al. | |
| D467,477 | S | 12/2002 | Berens | |
| 6,692,387 | B2 | 2/2004 | Berens et al. | |
| 6,866,597 | B2 * | 3/2005 | Kim | 473/553 |
| 2004/0047699 | A1 * | 3/2004 | Travez et al. | 408/239 R |
| 2004/0048699 | A1 * | 3/2004 | Kim | 473/553 |
| 2005/0101421 | A1 * | 5/2005 | Marangoni | 473/553 |
| 2005/0159254 | A1 * | 7/2005 | Solin | 473/557 |
| 2006/0026847 | A1 * | 2/2006 | Travez et al. | 30/342 |

* cited by examiner

*Primary Examiner*—Raleigh W. Chiu
(74) *Attorney, Agent, or Firm*—Michael I Kroll

(57) ABSTRACT

A stringed-racquet pick including a handle body and a string-realignment member having a conical head with a circumferentially position ridge along the base forming a stop. Furthermore, the handle body tapers to an appropriately smaller cross sectional area on the handle side of the base ridge thereby serving as a finger support surface as the tool is being used. The present invention provides a device for fastening to an article depending from the handle body, such as a clip whereby the racquet pick can be clipped to a pocket. Additionally, the handle body can have a compartment including a device for providing access thereto.

16 Claims, 16 Drawing Sheets

RACQUET-STRING ALIGNMENT PICK

BACKGROUND OF THE INVENTION

1. Field of the Invention

The present invention relates generally to tools and, more specifically, to a racquet string alignment pick comprising a handle body and a string-realignment member comprising a conical head with a circumferentially position ridge along the base forming a stop. Furthermore, the handle body tapers to an appropriately smaller cross sectional area on the handle side of the base ridge thereby serving as a finger support surface as the tool is being used. The present invention provides means for fastening to an article depending from the handle body, such as a clip whereby the racquet pick can be clipped to a pocket. Additionally, the handle body can have a compartment including means for access thereto.

The racquet pick of the present invention is held in a stationary position utilizing a wrap-around type grip of one's hand below the stop means function of the device. This is to prevent the strings from advancing beyond a desired degree and also to keep the user's hand protected during operational use. The conical shaped end portion of the device is to be exposed in an upward manner that is perpendicular to the flat surface plane of the stringed sport racquet. The racquet itself is held by the opposite hand above the device and is moved rapidly up and down over the area of the displaced strings. Since the strings of a strung racquet are initially placed under tension as a result of the racquet stringing process, there is a built in resiliency that the device utilizes to its advantage. This natural tendency of the displaced strings to return to the least resistive position (straight) enables the device to dislodge them from being stuck with a minimal amount of effort.

As the open space between the displaced strings is penetrated by the racquet pick, the resulting pressure easily allows the strings to become unstuck and move back to the correct alignment. The racquet can also be moved laterally, in concert with the up and down motion, to cover a greater surface area. The racquet pick is so quick and effective when used in this manner that the player does not have to resort to having to aim the device or insert it with exact precision over the very spot that needs aligning. A general canvassing of the area does the trick. This is an important feature of the racquet pick because it doesn't require much time or concentration to use. The device is designed to be used primarily during those times when play is momentarily paused, which regularly occurs during the course of play.

The racquet pick eliminates the risk of a player injuring a finger, breaking a fingernail or ruining polished nails in an attempt to straighten out displaced racquet strings using their fingertips, which currently happens to be the common method.

The racquet pick is small enough to be carried in a pocket during play or it can be attached to an article of clothing by means of clip portion for easy accessibility. The aperture on one end of the device enables it to be attached to a hook, keyring, clip, lanyard, cord (retractable or otherwise) etc., also for easy accessibility and for carrying purposes.

2. Description of the Prior Art

There are other realignment devices designed for stringed racquets. Typical of these is U.S. Pat. No. 3,968,902 issued to Bachmann on Jul. 13, 1976.

Another patent was issued to Newburger, et al. on May 16, 1978 as U.S. Pat. No. 4,089,523. Yet another U.S. Pat. No. 4,336,882 was issued to Sakwa on Jun. 29, 1982 and still yet another was issued on Aug. 14, 1984 to Darbo as U.S. Pat. No. 4,465,191.

Another patent was issued to Herbert on Mar. 29, 1988 as U.S. Pat. No. 4,733,866. Yet another U.S. Pat. No. 4,752,071 was issued to Tabach on Jun. 21, 1988. Another was issued to Ho on Oct. 11, 1988 as U.S. Pat. No. 4,776,591 and still yet another was issued on Jul. 30, 1991 to Redrow as U.S. Pat. No. 5,035,429.

Another patent was issued to McDermott on Sep. 17, 1991 as U.S. Pat. No. 5,050,053. Yet another U.S. Pat. No. 5,207,423 was issued to Short on May 4, 1993. Another was issued to Chan on May 10, 1994 as U.S. Pat. No. 5,310,181 and still yet another was issued on Nov. 29, 1994 to Hanshaw as U.S. Pat. No. 5,368,406.

Another patent was issued to Pagan on Aug. 15, 1995 as U.S. Pat. No. 5,441,258. Yet another U.S. Pat. No. 5,653,441 was issued to Woltanski on Aug. 5, 1997. Another was issued to Harren, et al. on Oct. 20, 1998 as U.S. Pat. No. 5,823,900 and still yet another was issued on Feb. 29, 2000 to Tate as U.S. Pat. No. 6,030,298.

Another patent was issued to Muller, et al. Jul. 2, 2002 on Aug. 15, 1995 as U.S. Pat. No. 6,413,173. Yet another U.S. Design Patent No. D467,477 was issued to Berens, on Dec. 24, 2002. Another was issued to Berens, et al. on Feb. 17, 2004 as U.S. Pat. No. 6,692,387 and still yet another was issued on Jan. 29, 1986 to Beffa as U.K. Patent No. GB2162127.

U.S. Pat. No. 3,968,902

Inventor: Mario E. Bachmann

Issued: Jul. 13, 1976

This invention relates to a personal automatic tablet dispenser for the pocket or purse adapted to contain medical pills, vitamins, sugar substitutes, or the like and in the form of a container shaped somewhat like a writing pen of the ball point type. The dispenser mechanically discharges its contents one item at a time and includes relatively slidable barrel elements forming a housing for a plurality of stacked tablets or the like with a releasable lock mechanism to secure the barrel elements against relative movement. A chamber for one tablet to be discharged is provided and turning means is formed in the housing to position a tablet for passage into the chamber in position for ultimate discharge. The barrel elements are operated against the pressure of a spring means which returns the elements to normally closed position.

U.S. Pat. No. 4,089,523

Inventor: Susan Newburger, et al.

Issued: May 16, 1978

An aligning tool for realigning misaligned strings in the central zone of the string network of a racket after heavy use to return the strings in a normal predetermined spacing, which tool includes a plurality of spaced right pyramidal projections extending from a base, the tool projections being adapted to be inserted between the strings to force misaligned strings of the racket back to a normal aligned condition.

U.S. Pat. No. 4,336,882

Inventor: Sydney M. Sakwa

Issued: Jun. 29, 1982

A container in the form of a pocket pen which is formed with a plurality of compartments for containment of medical pills and is fitted with a container for dispensing of powders such as dietetic salt or sugar substitutes. The device appears to be in the form of a conventional pocket pen fitted with a conventional removable cap section. A pill chamber in the cap section is capped by a removable hollow plug unit at the end of the cap section for containment and dispensing of powder. The plug unit is fitted with an external rotatable cover formed in one radial section of the cover with perforations and with the external cover rotatably joined to an interior cover by a rivet with an opening in the interior cover located so that the exterior cover may be rotated so as to either close the opening of the interior cover or to align that opening with the perforations of the external cover. The body section of the device is formed with two pill chambers separated by a transverse fixed partition, with one pill chamber capped by a removable plug unit incorporating a ball point and the other pill chamber capped by a removable hollow plug unit similar to that of the cap section for containment and dispensing of powder. Each of the three plug units is formed with a flange on which numerals, separating hours of the day, are marked, and fixed indicia are located on the exterior of the body and cap sections so as to align with a numeral of a plug flange.

U.S. Pat. No. 4,465,191

Inventor: Rolf E. Darbo

Issued: Aug. 14, 1984

A tablet dispenser is disclosed having an elongate hand-held core with a plurality of cavities adapted to contain tablets. A sheath is mounted to the core for slideable movement from a position covering all the cavities to another position uncovering all the cavities. A detent mechanism is employed between the sheath and the core for interrupting the sliding movement after each of the cavities has been uncovered. For spatially orienting the tablet dispenser, and without the need to look at it, distinct physical touch indicia is fixed to the dispenser in lengthwise alignment with the tablet cavities.

U.S. Pat. No. 4,733,866

Inventor: Jacob F. Herbert

Issued: Mar. 29, 1988

A portable string aligner for tennis rackets, racquetball rackets, and for other game equipment in which a racket is used. The aligner combines an elongated rectangular base member with multiple spacing pegs removably fitted in a retainer track. The spacing-peg tops protruding externally through a track opening in one surface of the base member are of sufficient length and are shaped to fit through the squares formed by the vertical and horizontal cross-over over of the racket strings in a strung racket head. By hand pressuring the spacing pegs through the racket string squares, the racket strings can be restored to proper alignment on the court during pauses in play.

U.S. Pat. No. 4,752,071

Inventor: Julias Tabach

Issued: Jun. 21, 1988

A device for straightening misaligned strings of a stringed racket, including an elongated rigid member forming a substitute finger. One end of the device includes a gripping member for gripping the device and a hook is supported from the other end of the elongated member and extending transversely thereto. The hook has both forwardly facing and rearwardly facing bent portions, so that it may be used alternately for pushing or pulling a selected string.

U.S. Pat. No. 4,776,591

Inventor: Sai Ho

Issued: Oct. 11, 1988

A racket string straightner including an elongate holder having a straight row of individually slidable teeth mounted therein. Each tooth has a string-receiving notch, and the notches are aligned along the row so as to straighten a string received therein. An aperture is provided in each tooth so as to extend transversely to the longitudinal axis of the holder, for receiving a string transverse to the string to be straightened.

U.S. Pat. No. 5,035,429

Inventor: Allan Redrow

Issued: Jul. 30, 1991

A device is shown that is adapted to be placed on the strings in the head of a tennis racket adjacent a bowed or displaced string in the woven pattern of strings, which device can be manually manipulated to move the string back to its correct position in the woven pattern. The string straightener is constructed to automatically adjust itself to be fitted to any conventional woven string pattern in the usual form of tennis rackets.

U.S. Pat. No. 5,050,053

Inventor: Kevin McDermott

Issued: Sep. 17, 1991

A battery powered pocket flashlight has a noncorrosive and electrically nonconductive case containing a restrictive aperture for the projection of light from the lamp source and a resilient color filter attached externally upon the end of the case by integral stub axles extending inward into the case for an axis of rotation intersecting perpendicular to the longitudinal axis of the flashlight for operation by the user in the selection of unfiltered light of the lamp source or a light at a color of the visible spectrum of colors. The filter is secured to the case by resilience of the filter material and by its shape in the form of an acute sector of a sphere. The electrical sub-system is completely removable from the case for servicing. The flashlight is controlled by compression of a conical helical spring conductor having coiled turns that collapse under compression upon the negative return surface of the battery for switching current to the lamp bulb through a one piece conductor that includes the switching helical spring plus a conductor extending past the batteries to an integral holder for the lamp bulb. A nonconducting pocket clip and combined switch actuator is movable axially to the case for compression of the helical switching spring.

U.S. Pat. No. 5,207,423

Inventor: David Short

Issued: May 4, 1993

The improved tennis racket string straightener is a one-piece unitary pocket comb, preferably of molded plastic, with an elongated body and spaced integral teeth depending therefrom along the length thereof. The body has curved ends to prevent pocket snagging and includes a vertical lower plate from which the teeth depend, and a top horizontal flange acting as a hand grip. The plate is integral with the flange and connected thereto along the longitudinal center-line thereof. The teeth in one embodiment are all the same size and spacing. In another embodiment the teeth are of generally similar shape and size but the distance between adjacent teeth gradually increases the farther the teeth are away from the mid-point along the length of the comb. The teeth are generally triangular in front, rear and side elevation, thus generally wedge-shaped with apices pointing down, and the spaces defined thereby are generally triangular with their apices up. All apices are slightly rounded to prevent string damage. The sides of the teeth are recessed to provide raised rims. The rims, teeth, flange and plate are not more than about ¼ inch thick for maximum dimensional stability during molding.

U.S. Pat. No. 5,310,181

Inventor: Stephen Chan

Issued: May 10, 1994

This invention pertains to a novel aligner which can be used to space evenly the strings of a sports racquet. More particularly, this invention pertains to a novel racquet string aligner which can accommodate different racquet string spacings and can be used as the cap for a typical container for tennis balls. A racquet string aligner for aligning the strings of a racquet comprising: (a) a base member; (b) a tapered central projection on the base member having a topography that tapers away from the base member; 8 at least one tapered first projection adjacent the central projection the base of which is located a first radius from the center-point of the central projection, and at least a portion of the upper surface of which has a first slope in the direction of the central projection; and (d) at least one tapered second projection the base of which is located at a second radius from the center-point of the central projection greater than that of the first radius and at least a portion of the upper surface of which slopes in the same direction as the slope of the first projection in the direction of the central projection to a degree smaller than the first slope.

U.S. Pat. No. 5,368,406

Inventor: Paul C. Hanshaw

Issued: Nov. 29, 1994

A pen-type device utilizing a combination type lock that operatively engages or releases an actuating member which is constructed and arranged to hold a replaceable element such as a ball point pen refill insert or pill dispenser.

U.S. Pat. No. 5,441,258

Inventor: Salvadore E. Pagan

Issued: Aug. 15, 1995

A tool for aligning the strings of a racket, the tool having a base, a support bracket attached to the base for pivotally securing the racket to the base, a positioning pin for positioning the racket in a predetermined location on the base, and an array of spaced alignment pins projecting upward from the base for aligning the racket strings in predetermined positions.

U.S. Pat. No. 5,653,441

Inventor: Theodore M. Woltanski

Issued: Aug. 5, 1997

This invention relates to a racket string comb, to be used on the strings in the head of a tennis, racquetball, squash or badminton racket, that can be manually manipulated to move the strings back to their correct position. The improved tennis racket string straightener is a one-piece pocket comb, preferably of molded plastic, which consists of a comb body and integrally placed, widely spaced, narrow claws depending therefrom, along the width thereof. The claws in the preferred embodiment are all of the same size and spacing. The comb body has a handle extended from the comb body at a generally fortyfive degree angle, rounded at the bottom to provide finger comfort and prevent pocket snagging.

U.S. Pat. No. 5,823,900

Inventor: Ernst-Diethelm Harren, et al.

Issued: Oct. 20, 1998

The device (1) is used for aligning the strings of the netting, and particularly the netting of a tennis racket. In order to align the strings of the netting in a simple, accurate, quick and effortless manner, without damaging the strings, the aligning device has semi-ellipsoidal, semi-circular or oval platelets that act on the strings at their crossing points.

U.S. Pat. No. 6,030,298

Inventor: John R. Tate

Issued: Feb. 29, 2000

A golf surface repair tool having a pair of legs for repairing a golfing surface following a shot is provided with internal implements that may be utilized as well. Specifically, the golf surface repair tool is fabricated utilizing at least three releasably interengageable body members. The legs of the repair tool extend from the first body member, which also defines an open mouth and a hollow cavity therewithin at its opposite end. The second body member has a closed end and an opposing open mouth and also defines at least one hollow cavity therewithin. A third body member is formed with a central base and a pair of pedestals which project from the base in opposite directions from each other. The pedestals have sides that respectively fit snugly in frictional or other engagement into the open mouths of the first and second body members. One or more writing implements, such as a marking pen for marking golf balls and/or a lead pencil for writing golf scores on a score card, are mounted to one of the pedestals projecting out from the central base. A brush is mounted to the other pedestal and projects in a direction opposite the writing implements. The brush and the writing implements are thereby enclosed within the hollow cavities of the first and second body members when the pedestals of the third body member are engaged with the first and second body members.

U.S. Pat. No. 6,413,173

Inventor: Walter Muller, et al.

Issued: Jul. 2, 2002

The invention relates to an especially handy and user-friendly multiple purpose tool for the sport of golf, which is light yet solidly built. Operation of the pitch fork is done with one hand, as well as the removal and insertion of the ball marker. The blade of a new kind of tee hole puncher for hard or frozen ground also serves for cleaning the flutes of the golf club. It is also combined with additional functional elements like nail files, cap openers, and the like. The economically manufacturable tool can also include, for general use, a knife blade, a scissors, a pincer, a tooth pick, a ball point pen, and other tools as the case may be.

U.S. Design Patent Number D467,477

Inventor: Randall S. Berens, et al.

Issued: Dec. 24, 2004

The ornamental design for a racket string straightener as shown in the drawings.

U.S. Pat. No. 6,692,387

Inventor: Randall S. Berens, et al.

Issued: Feb. 17, 2004

A tool for realigning or straightening the strings of a racquet. The tool has a generally rectangular tip which is precisely dimensioned to fit within the normal space between the strings of a racquet. To realign the racquet strings, the tip is placed into the space defined by the strings and the strings are automatically adjusted to their preferred alignment. The string straightening tool is portable and compact, allowing the user to carry the device on his/her person and to use the device during lulls in play during the game.

U.K. Patent Number GB2162127

Inventor: Giorgio Della Beffa

Issued: Jan. 29, 1986

A ball-point pen has a case 2 with a front end piece 5 which contain an ink tube 6 having a ball point 6a. The case 2 also contains a rechargeable container 7 which has a filling and discharge spout 7a for any liquid, such as a medicine. The container 7 is rebated at 7b so that the ink tube 6 lies in the rebate. The rear end of the case 2 is closed by an end piece 4 which is internally screw-threaded at 4a to screw over the spout 7a. The arrangement enables the pen to carry a small dose of medicine for emergency use, which is easily accessible by removing the end piece 4.

While these realignment devices may be suitable for the purposes for which they were designed, they would not be as suitable for the purposes of the present invention, as hereinafter described.

SUMMARY OF THE PRESENT INVENTION

A primary object of the present invention is to provide a racquet pick for a stringed racquet having a handle body and a string-realignment member.

Another object of the present invention is to provide a racquet pick for a stringed racquet wherein said string-realignment member is comprised of a conical head with a circumferentially positioned ridge along the base forming a stop.

Yet another object of the present invention is to provide for a racquet pick for a stringed racquet wherein said conical head base ridge slopes to a smaller cross sectional area serving as finger support during tool use.

Still yet another object of the present invention is to provide a racquet pick for a stringed racquet having a handle body incorporating article fastening means whereby said tool can be fastened to an article, such as a garment pocket by means of a clip depending from the handle body.

Another object of the present invention is to provide a racquet pick for a stringed racquet wherein said handle body can have an interiorly positioned compartment.

Yet another object of the present invention is to provide a racquet pick for a stringed racquet wherein said handle body includes means for access said interiorly positioned compartment.

Still yet another object of the present invention is to provide a racquet pick for a stringed racquet wherein said handle body compartment access includes threadedly removing a tool portion thereby providing access to said interiorly positioned compartment.

Additional objects of the present invention will appear as the description proceeds.

The present invention overcomes the shortcomings of the prior art by providing a stringed-racquet pick comprising a handle body and a string-realignment member comprising a conical head with a circumferentially positioned ridge along the base forming a stop. Furthermore, the handle body tapers to an appropriately smaller cross sectional area on the handle side of the base ridge thereby serving as a finger support surface as the tool is being used. The present invention provides means for fastening to an article depending from the handle body, such as a clip whereby the racquet pick can be clipped to a pocket. Additionally, the handle body can have a compartment including means for access thereto.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawings in which.

DESCRIPTION OF THE REFERENCED NUMERALS

Figure 1:
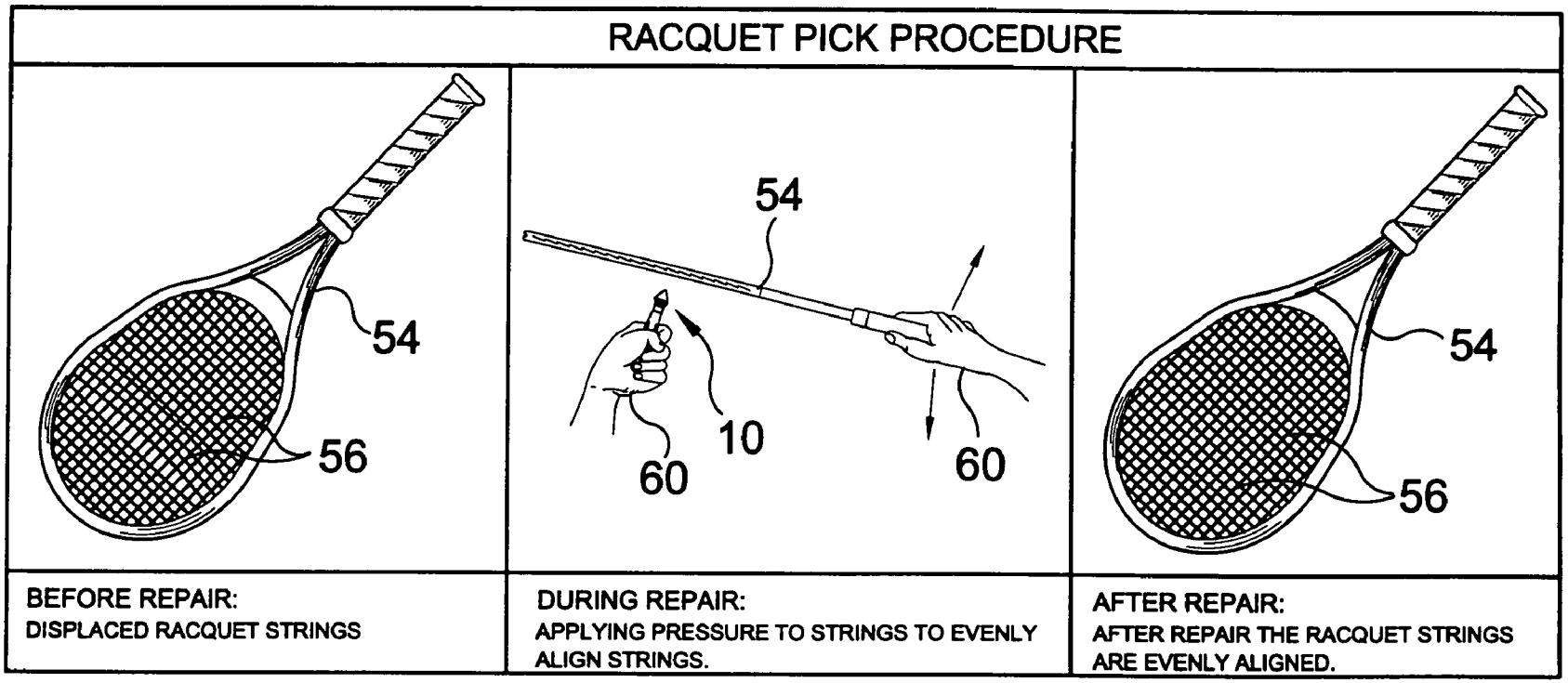
FIG. 1 is an illustrative view of the present invention in use.

Turning now descriptively to the drawings, in which similar reference characters denote similar elements throughout the several views, the figures illustrates the Racquet-String Alignment Pick of the present invention. With regard to the reference numerals used, the following numbering is used throughout the various drawing figures.

10 Racquet String Alignment Pick of the present invention
12 handle body
14 spacer head
16 stop member
18 first end of 12
20 second end of 12
22 clip
24 retractable cord aperture
26 eyelet
28 interior storage chamber
30 female threads of 28
32 removable cap member
34 male threads of 32
36 flip-top cap member
38 rotatable cap member
39 insert member of 38
40 niche of 28
42 tab of 38
44 inner fill hole aperture
46 outer fill hole aperture
48 open slot
50 groove
52 perforations
54 racquet
56 racquet strings
58 user
60 hand of 58
62 pocket
64 indicia

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention 10 in use. The racquet-string alignment pick of the present invention 10 is held in a stationary position utilizing a wrap-around type grip of one's hand 60 below the stop means function of the device. This is to prevent the strings 56 from advancing beyond a desired degree and also to keep the user's hand 60 protected during operational use. The conical shaped end portion of the device is to be exposed in an upward manner that is perpendicular to the flat surface plane of the stringed sport racquet 54. The racquet 54 itself is held by the opposite hand 60 above the device and is moved rapidly up and down over the area of the displaced strings 56. Since the strings 56 of a strung racquet 54 are initially placed under tension as a result of the racquet-stringing process, there is a built in resiliency that the device utilizes to its advantage. This natural tendency of the displaced strings 56 to return to the least resistive position (straight) enables the device to dislodge them from being stuck with a minimal amount of effort.

As the open space between the displaced strings 56 is penetrated by the racquet pick 10, the resulting pressure easily allows the strings 56 to become unstuck and move back to the correct alignment. The racquet 54 can also be moved laterally, in concert with the up and down motion, to cover a greater surface area. The racquet pick 10 is so quick and effective when used in this manner that the player does not have to resort to having to aim the device or insert it with exact precision over the very spot that needs aligning. A general canvassing of the area does the trick. This is an important feature of the racquet pick 10 because it doesn't require much time or concentration to use. The device is designed to be used primarily during those times when play is momentarily paused, which regularly occurs during the course of play.

The racquet pick 10 eliminates the risk of a player injuring a finger, breaking a fingernail or ruining polished nails in an attempt to straighten out displaced racquet strings 56 using their fingertips, which currently happens to be the common method.

The racquet pick 10 is small enough to be carried in a pocket during play or it can be attached to an article of clothing by means of clip portion for easy accessibility. The aperture on one end of the device enables it to be attached to a hook, keyring, clip, lanyard, cord (retractable or otherwise) etc., also for easy accessibility and for carrying purposes.

Figure 2:
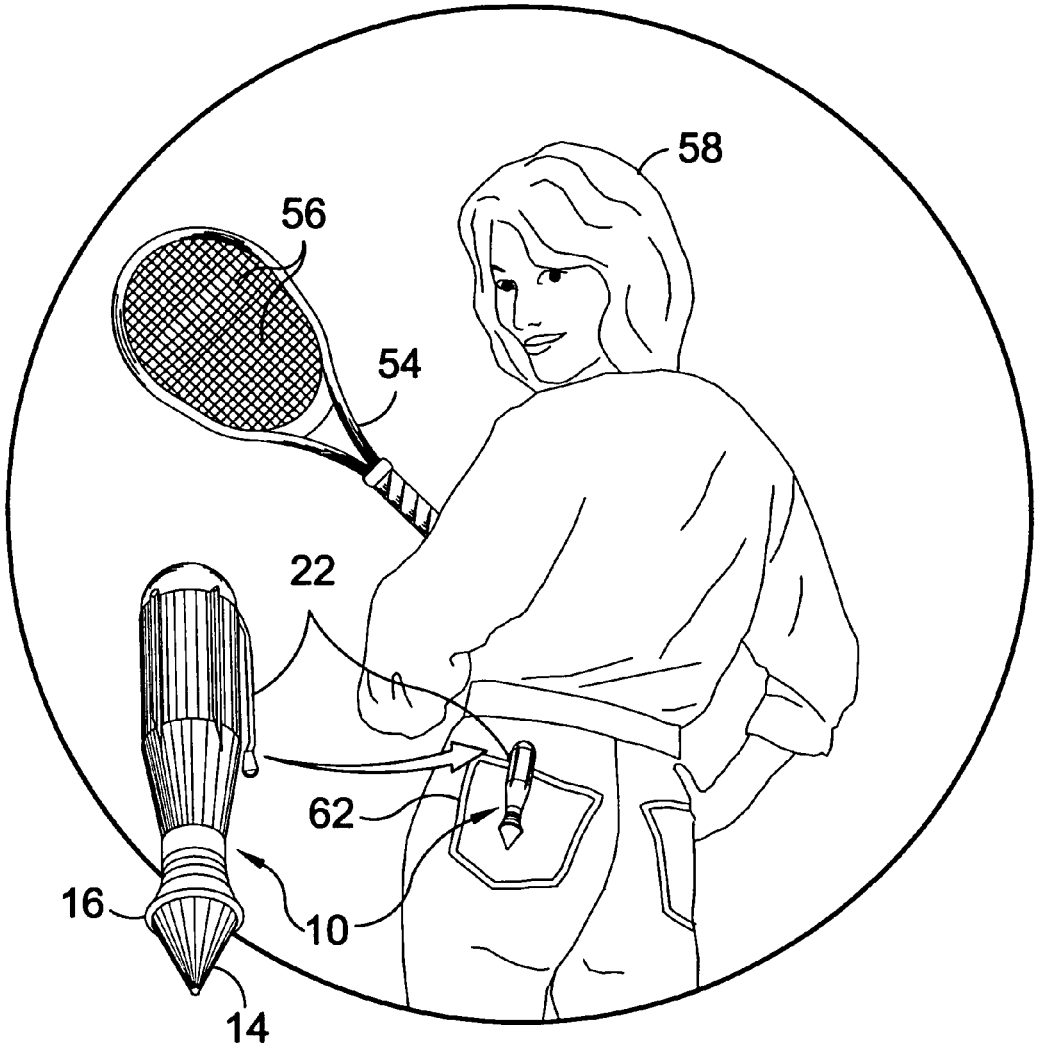
FIG. 2 is an illustrative view of the present invention in use.

FIG. 2 is an illustrative view of the present invention 10 in use. Shown is an illustrated view of the present invention 10 secured to a user's 58 pocket 62 by means of a clip 22. The device is a racquet-string alignment pick 10 that enables a player engaged in a sport requiring a stringed racquet 54 such as tennis, racquetball, squash and badminton to realign strings 56 that have become misplaced. The cylindrically shaped device has a conical shaped spacer head 14 which is held in a stationary position in one hand by the user 58 who then lightly thrusts the stringed racquet 54 surface down upon the spacer head 14 by means of the other hand holding the racquet. The spacer head 14 pokes through the stringed mesh area where the displacement has occurred and forces the strings 56 apart, thereby loosening them from their stuck position so that the pre-existing tension, already built into the strings when a racquet 54 undergoes the stringing process, results in the string 56 returning to an optimally and evenly placed position. A stop member 16 is provided to prevent the strings 56 of the racquet 54 from advancing beyond a desired degree.

Figure 3:
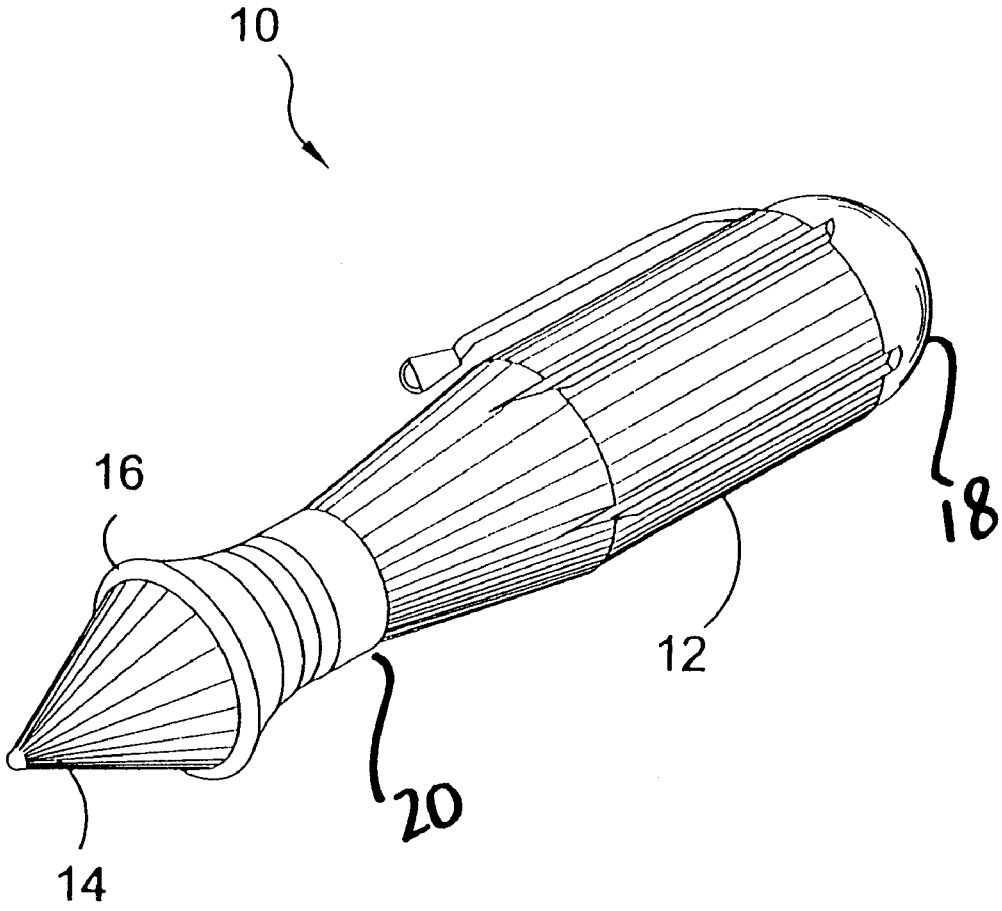
FIG. 3 is a perspective view of the present invention.

FIG. 3 is a perspective view of the present invention. The device is a racquet-string alignment pick 10 that enables a player engaged in a sport requiring a stringed racquet to realign strings that have become misplaced, the cylindrically shaped device has a conical shaped spacer head 14 which is held by the handle body 12 in a stationary position in one hand by the player who then lightly thrusts the stringed racquet surface down upon the spacer head 14 by means of the other hand holding the racquet. The spacer head 14 pokes through the stringed mesh area where the displacement has occurred and forces the strings apart, thereby loosening them from their stuck position so that the pre-existing tension, already built into the strings when a racquet undergoes the stringing process, results in the strings returning to an optimally and evenly placed position. A stop member 16 is provided to prevent the strings 56 of the racquet 54 from advancing beyond a desired degree.

Figure 4:
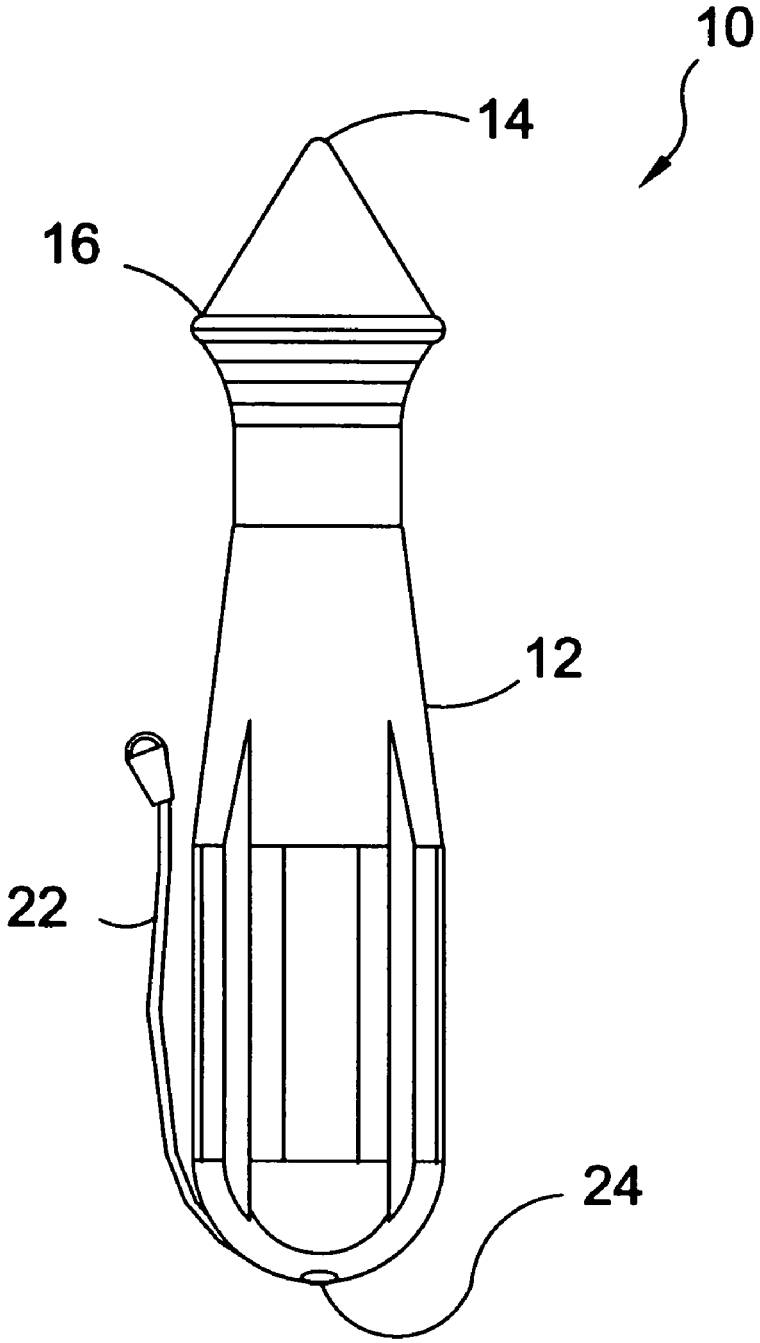
FIG. 4 is an orthographic view of the present invention.

FIG. 4 is an orthographic view of the present invention. The device is a racquet-string alignment pick 10 that enables a player engaged in a sport requiring a stringed racquet to realign strings that have become misplaced. The cylindrically shaped device has a conical shaped spacer head 14 which is held by the handle body 12 in a stationary position in one hand by the player who then lightly thrusts the stringed racquet surface down upon the spacer head 14 by means of the other hand holding the racquet. The spacer head 14 pokes through the stringed mesh area where the displacement has occurred and forces the strings apart, thereby loosening them from their stuck position so that the pre-existing tension, already built into the strings when a racquet undergoes the stringing process, results in the strings returning to an optimally and evenly placed position. A stop member 16 is provided to prevent the strings 56 of the racquet 54 from advancing beyond a desired degree. A clip 22 is provided to fasten the device to an article of clothing as well as a retractable cord aperture 24 for attaching a retractable cord thereto.

Figure 5:
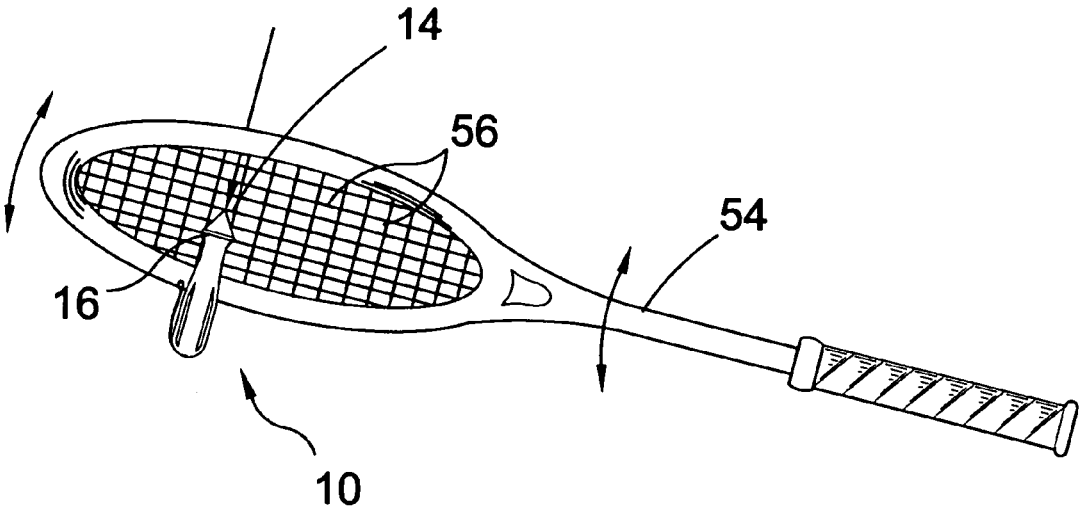
FIG. 5 is an illustrative view of the present invention in use.

FIG. 5 is an illustrative view of the present invention 10 in use. The cylindrically shaped racquet-string alignment pick 10 has a conical shaped spacer head 14 which is held in a stationary position in one hand by the player who then lightly thrusts the stringed racquet 54 surface down upon the device by means of the other hand holding the racquet 54. The spacer head 14 pokes through the stringed mesh area where the displacement has occurred and forces the strings 56 apart, thereby loosening them from their stuck position so that the pre-existing tension, already built into the strings 56 when a racquet 54 undergoes the stringing process, results in the strings 56 returning to an optimally and evenly placed position. A stop member 16 is provided to prevent the strings 56 of the racquet 54 from advancing beyond a desired degree.

Figure 6:
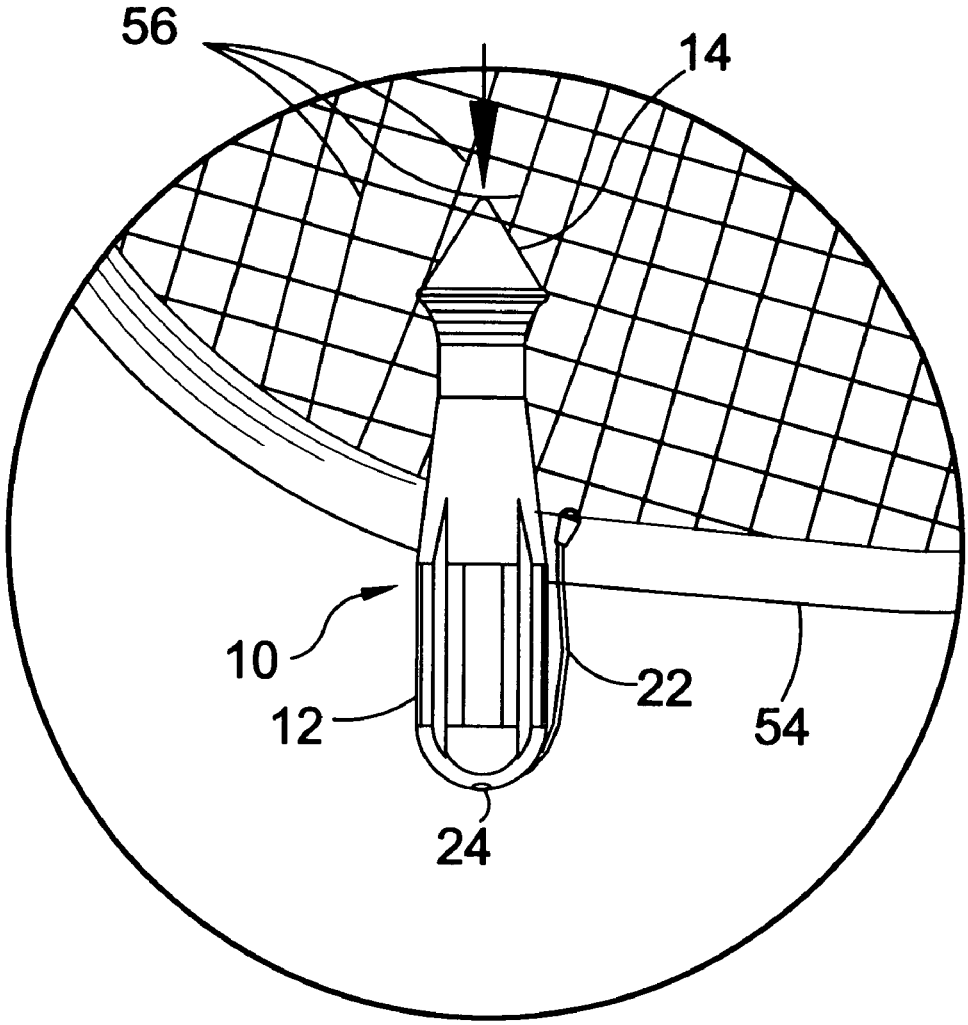
FIG. 6 is a detailed view of the present invention in use.

FIG. 6 is a detailed view of the present invention 10 in use. The racquet-string alignment pick 10 enables a player engaged in a sport requiring a stringed racquet 54, such as tennis, racquetball, squash and badminton, to realign strings 56 that have become misplaced. The cylindrically shaped device has a conical-shaped spacer head 14 which is held in a stationary position in one hand by the player who then lightly thrusts the stringed racquet 54 surface down upon the spacer head 14 by means of the other hand holding the racquet 54. The spacer head 14 end pokes through the stringed mesh area where the displacement has occurred and forces the strings 56 apart, thereby loosening them from their stuck position so that the pre-existing tension, already built into the strings 56 when a racquet 54 undergoes the stringing process, results in the strings 56 returning to an optimally and evenly placed position. Also shown are the clip 22 and the retractable cord aperture 24.

Figure 7:
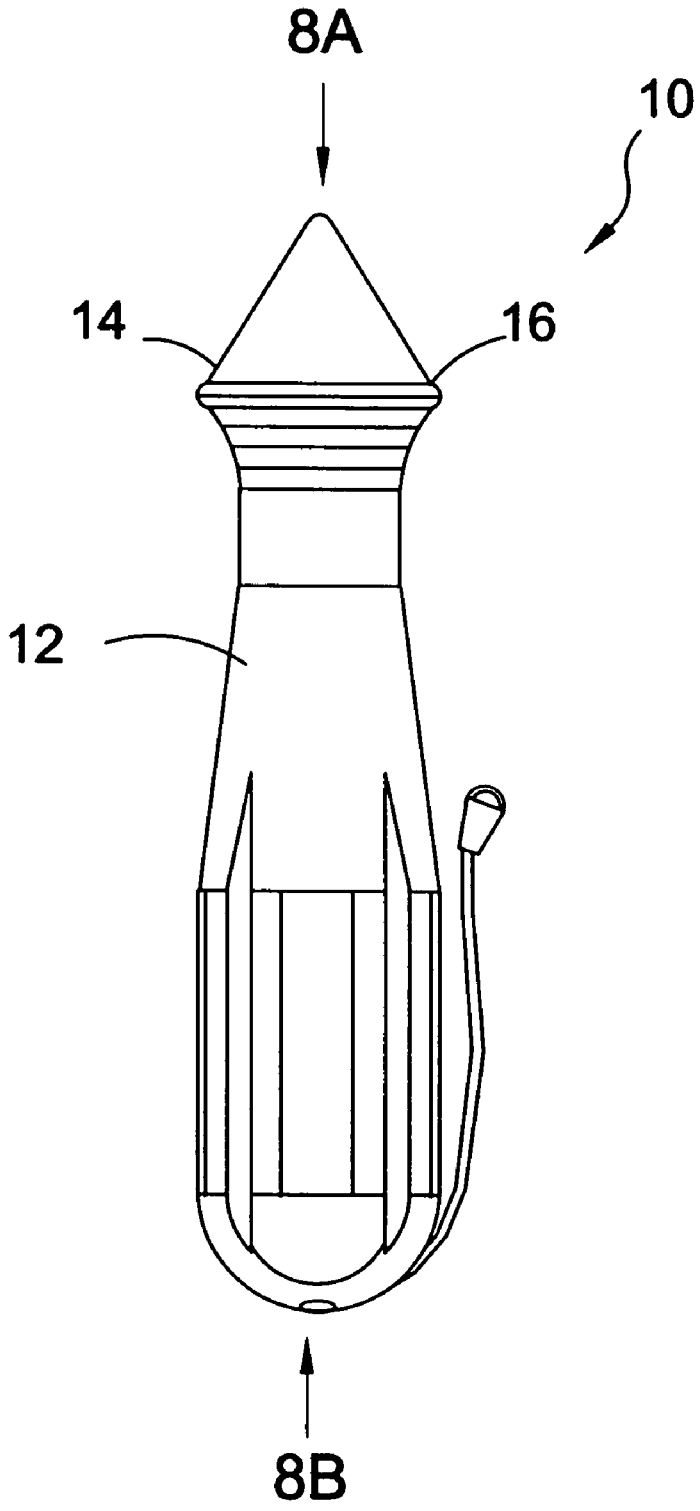
FIG. 7 is a view of an additional design of the present invention.

FIG. 7 is a view of an additional design of the present invention. The cylindrically shaped racquet-string alignment pick 10 has a conical shaped spacer head 14 which is held in a stationary position in one hand by the player who then lightly thrusts the stringed racquet surface down upon the device by means of the other hand holding the racquet. The spacer head 14 pokes through the stringed mesh area where the displacement has occurred and forces the strings apart, thereby loosening them from their stuck position so that the pre-existing tension, already built into the strings when a racquet undergoes the stringing process, results in the strings returning to an optimally and evenly placed position. A stop member 16 is provided to prevent the strings of the racquet from advancing beyond a desired degree. In this design, the handle body 12 of the device unscrews from the spacer head 14 of the device, allowing access to an interior storage chamber located in the handle body 12.

Figure 8:
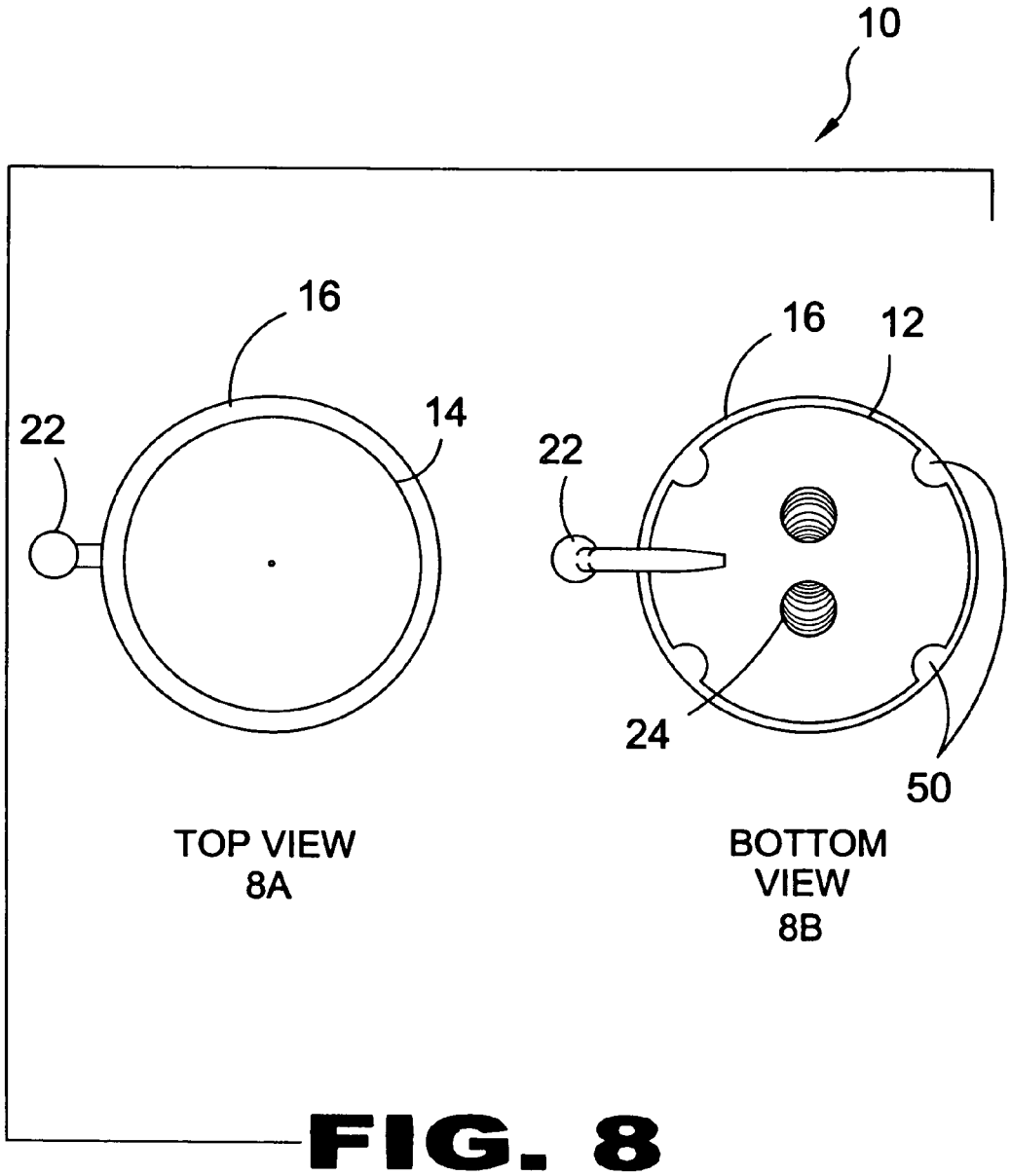
FIG. 8 is an orthographic view of the present invention.

FIG. 8 are orthographic views of the present invention 10. Shown is a top and bottom view of the present invention 10. The cylindrically shaped racquet-string alignment pick 10 has a conical shaped spacer head 14 which is held in a stationary position in one hand by the player who then lightly thrusts the stringed racquet surface down upon the device by means of the other hand holding the racquet. The spacer head 14 pokes through the stringed mesh area where the displacement has occurred and forces the strings apart, thereby loosening them from their stuck position so that the pre-existing tension, already built into the strings when a racquet undergoes the stringing process, results in the strings returning to an optimally and evenly placed position. A stop member 16 is provided to prevent the strings of the racquet from advancing beyond a desired degree. In this design, the handle body 12 of the device unscrews from the spacer head 14 of the device, allowing access to an interior storage chamber located in the handle body 12. Also shown are the clip 22 and the retractable cord aperture 24 and grooves 50 that are shown on the handle body 12.

Figure 9:
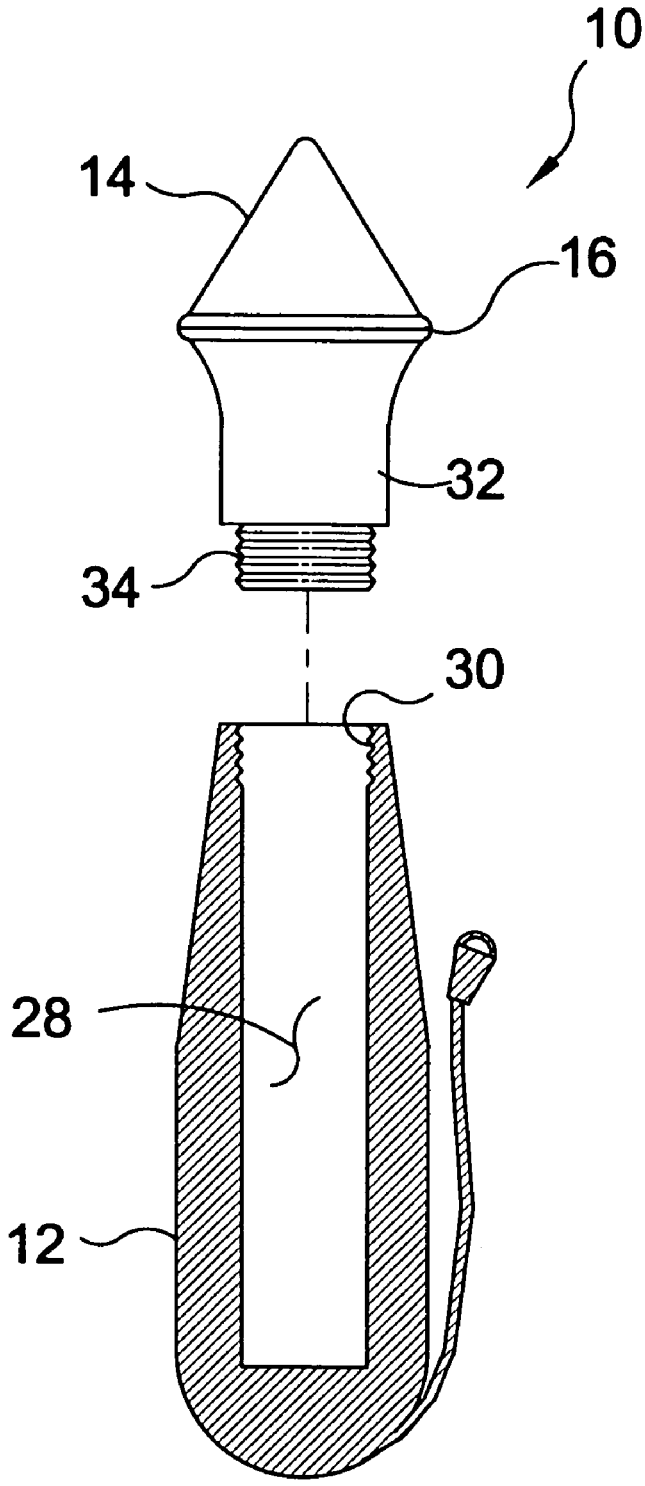
FIG. 9 is an exploded view of an additional design of the present invention.

FIG. 9 is an exploded view of an additional design of the present invention. The cylindrically shaped racquet-string alignment pick 10 has a conical shaped spacer head 14 which is held in a stationary position in one hand by the player who then lightly thrusts the stringed racquet surface down upon the device by means of the other hand holding the racquet. The spacer head 14 pokes through the stringed mesh area where the displacement has occurred and forces the strings apart, thereby loosening them from their stuck position so that the pre-existing tension, already built into the strings when a racquet undergoes the stringing process, results in the strings returning to an optimally and evenly placed position. A stop member 16 is provided to prevent the strings of the racquet from advancing beyond a desired degree. In this design, the handle body 12 has a hollow interior forming a storage chamber 28 with female threads 30 to accept the male threads 34 of a removable cap member 32 on which the spacer head 14 and stop member 16 are disposed.

Figure 10:
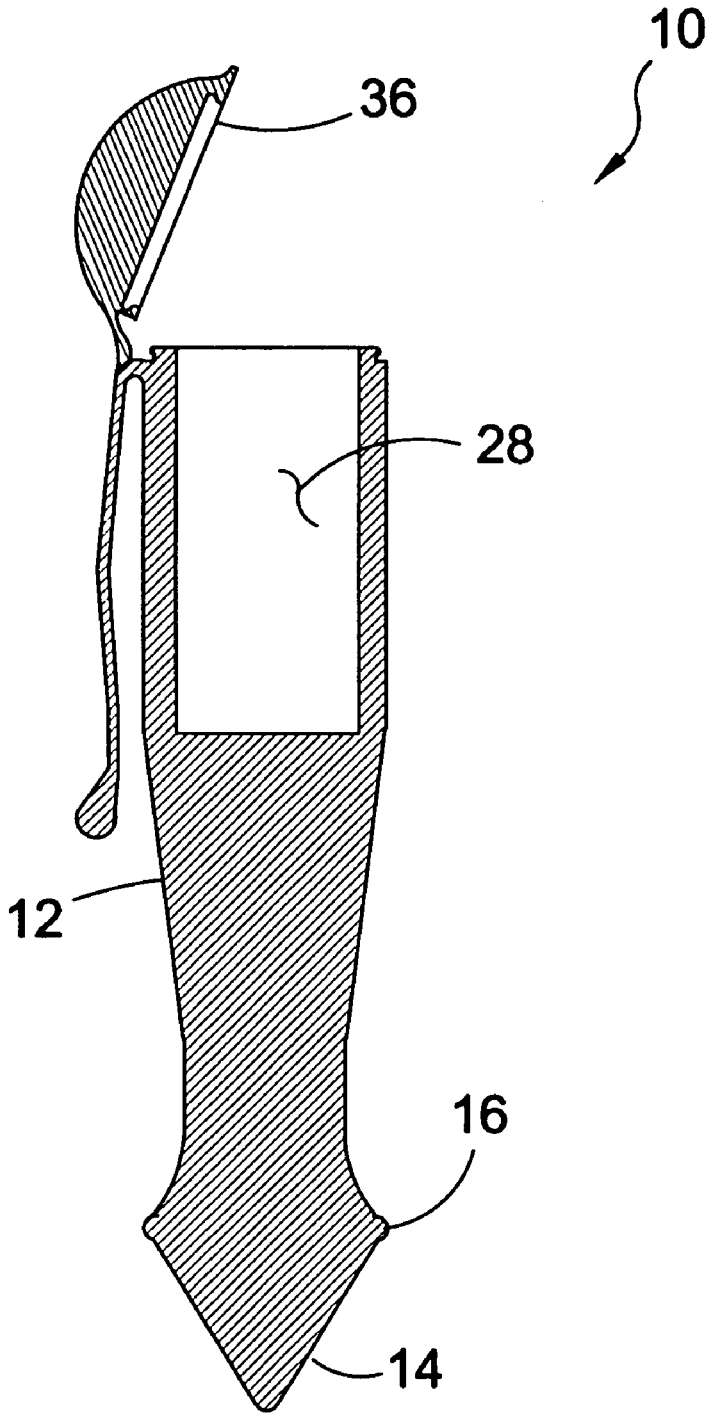
FIG. 10 is an additional design of the present invention.

FIG. 10 is an additional design of the present invention. The cylindrically shaped racquet-string alignment pick 10 has a conical shaped spacer head 14 which is held in a stationary position in one hand by the player who then lightly thrusts the stringed racquet surface down upon the device by means of the other hand holding the racquet. The spacer head 14 pokes through the stringed mesh area where the displacement has occurred and forces the strings apart, thereby loosening them from their stuck position so that the pre-existing tension, already built into the strings when a racquet undergoes the stringing process, results in the strings returning to an optimally and evenly placed position. A stop member 16 is provided to prevent the strings of the racquet from advancing beyond a desired degree. In this design, the handle body 12 has a hollow interior forming a storage chamber 28 that is accessible by means of a flip-top cap member 36 that is hingedly attached to the distal end of said handle body 12.

Figure 11:
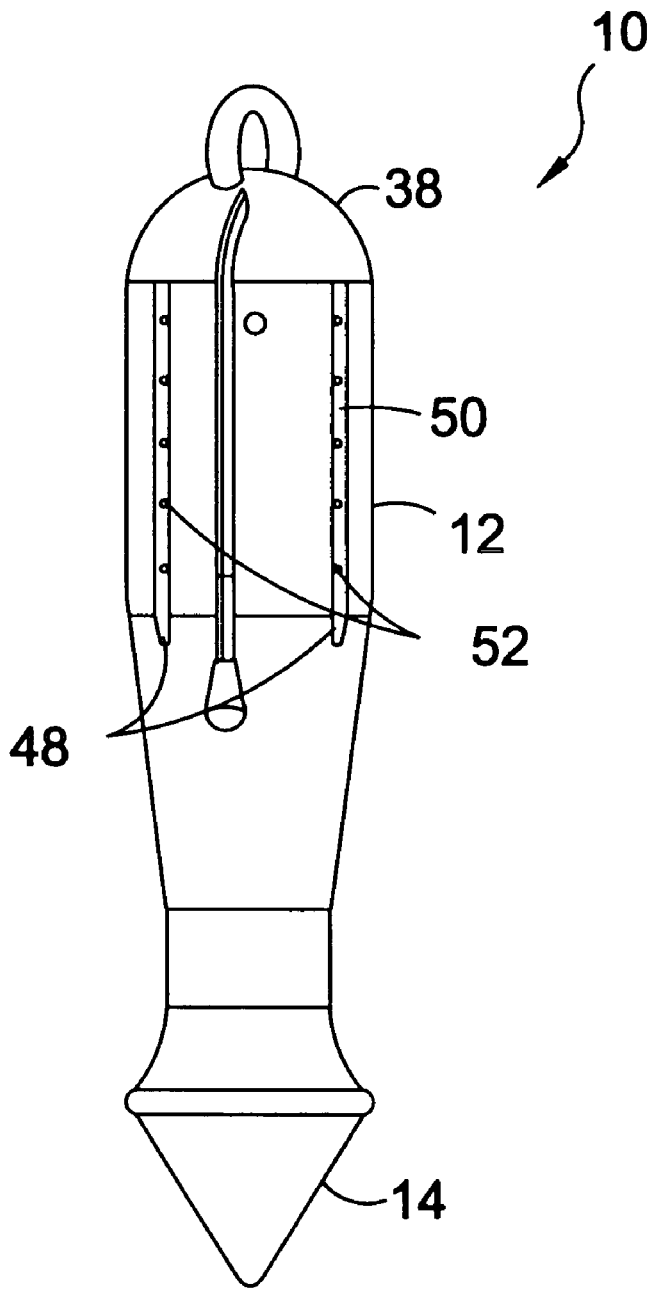
FIG. 11 is a view of an additional design of the present invention.

FIG. 11 is a view of an additional design of the present invention 10. This design enables the device to dispense a powdery substance (i.e. rosin, cornstarch, talc etc.) that a player might use to prevent moisture from building up on their hands, which may cause a slippery racquet grip from developing during play. The device is comprised of two parts, rotatable cap member 38 with a male insert member 39 depending therefrom and a handle body 12 with an integral spacer head 14 on one end and an open end leading into a substantially hollow interior chamber 28 disposed therein. The handle body 12 and the rotatable cap 38 permanently snap together upon assembly. A plurality of rows of perforations 52 are disposed in the handle body 12 and the rotatable cap member 38 is rotated to align them with corresponding open slots 48 in the adjacent insert member 39 to provide means of egress for dispensing the powdery substance therefrom.

Figure 12:
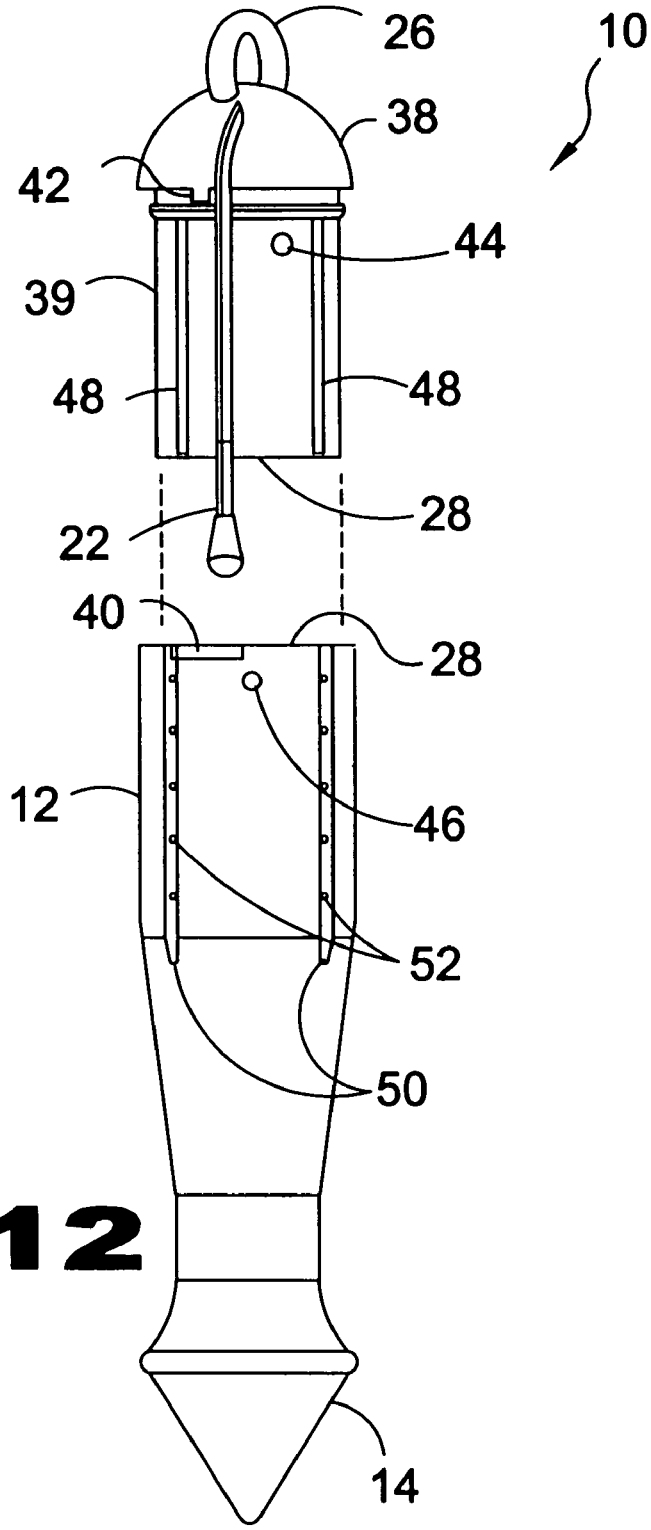
FIG. 12 is an exploded view of an additional design of the present invention.

FIG. 12 is an exploded view of an additional design of the present invention 10. This design enables the device to dispense a powdery substance (i.e. rosin, cornstarch, talc etc.) that a player might use to prevent moisture from building up on their hands, which may cause a slippery racquet grip from developing during play. The device is comprised of two parts, rotatable cap member 38 with a male insert member 39 depending therefrom and a handle body 12 with an integral spacer head 14 on one end and an open end leading into a substantially hollow interior chamber 28 disposed therein. The handle body 12 and the rotatable cap 38 permanently snap together upon assembly. A plurality of rows of perforations 52 are disposed in the handle body 12 and the rotatable cap member 38 is rotated to align them with corresponding open slots 48 in the adjacent insert member 39 to provide means of egress for dispensing the powdery substance therefrom.

The rotatable cap 38 has an eyelet 26 which can be used to attach the device to a clip or cord, etc., for fastening purposes. The clip 22 is rigidly attached to the rotatable cap 38 and is used for fastening purposes and/or setting the device to either one of three settings; "closed" or "fill" or "open". The swivel ability of the rotatable cap 38 is restricted to a fixed range of motion due to a small niche 40 within the handle body 12 that the tab 42 of the rotatable cap 38 is seated into.

In the closed position, the fill holes 44,46 are not aligned, nor are the perforations 52 in the grooves 50 of the handle body 12 with the corresponding slots 48 in the insert member 39 thereby preventing the entrance or egress to and from the interior chamber 28.

In the fill position, the fill holes 44,46 align themselves together so as to allow the interior chamber 28 of the device to be filled or refilled with a powdery substance.

In the open position, the perforations 52 are aligned with the slots 48, allowing the powdery substance to be dispensed. This works best when the cylindrically shaped device is rolled between the player's hands.

Having the perforations 52 located in the recessed areas within each concaved shaped groove 50 helps to prevent them from being clogged with moisture from the player's hands when the device is being rolled between them.

Figure 13:
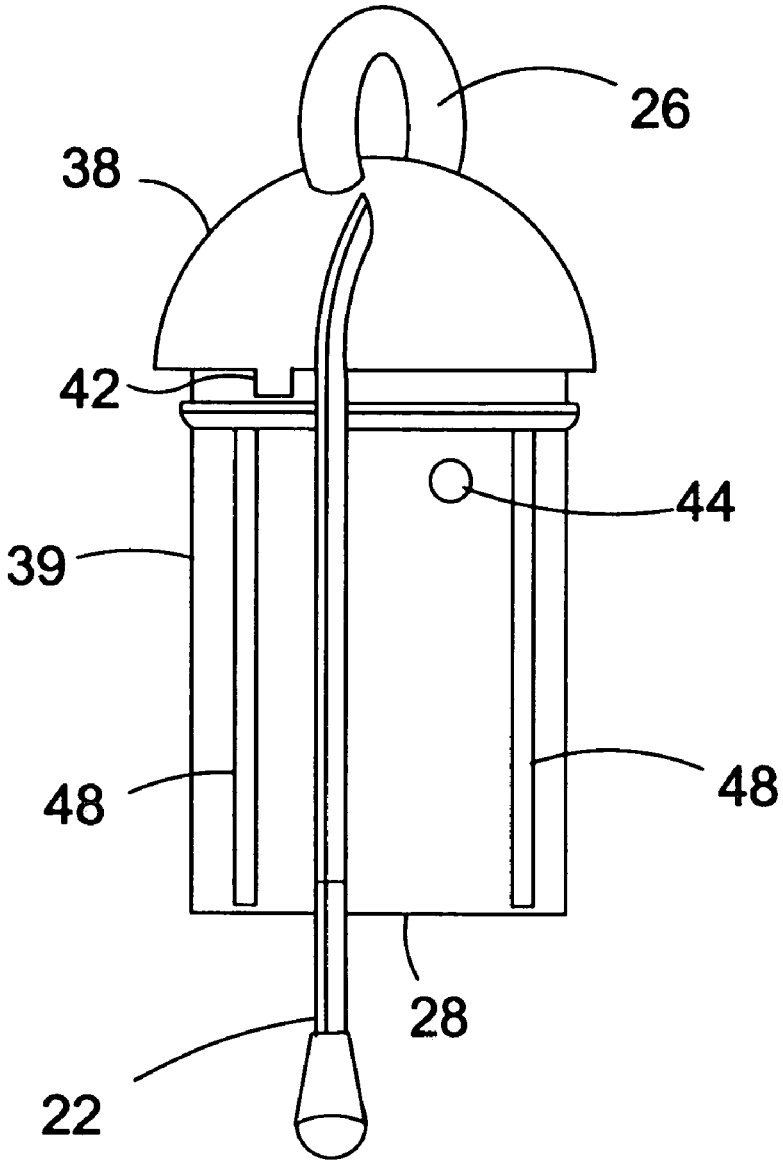
FIG. 13 is a detailed view of an additional design's male portion of the present invention.

FIG. 13 is a detailed view of an additional design's rotatable cap 38 of the present invention. This design enables the device to dispense a powdery substance (i.e. rosin, cornstarch, talc ect.) that a player might use to prevent moisture from building up on their hands, which may cause a slippery racquet grip from developing during play. Shown is the rotatable cap 38 with a tab 42, an eyelet 26 on the top portion thereof and the insert member 39 depending from the bottom having interior storage storage chamber 28 within the depending insert member 39. A plurality of open slots 48 are disposed on the insert member 39 as is the inner fill hole aperture 44. The clip 22 is also integral therewith.

Figure 14:
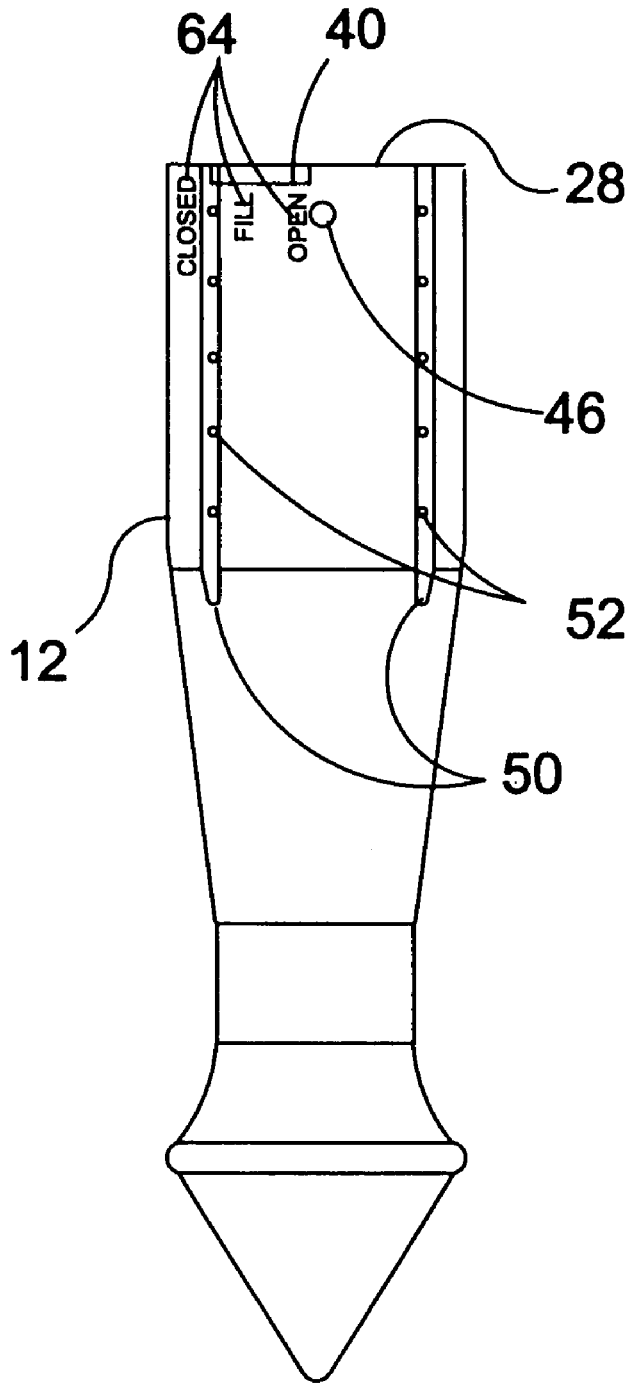
FIG. 14 is a detailed view of an additional design's female portion of the present invention.

FIG. 14 is a detailed view of an additional design's handle body 12 of the present invention. Shown is the handle body 12 having and interior chamber 28 with an outer fill hole aperture 46, a plurality of grooves 50 with each groove 50 having a plurality of perforation 52 disposed therein. Indicia 64 is provided to determine the status of the device accordingly as shown by the position of the clip during operation. A niche 40 works cooperatively with the tab on the rotatable cap member to restrict the rotational range thereof.

Figure 15:
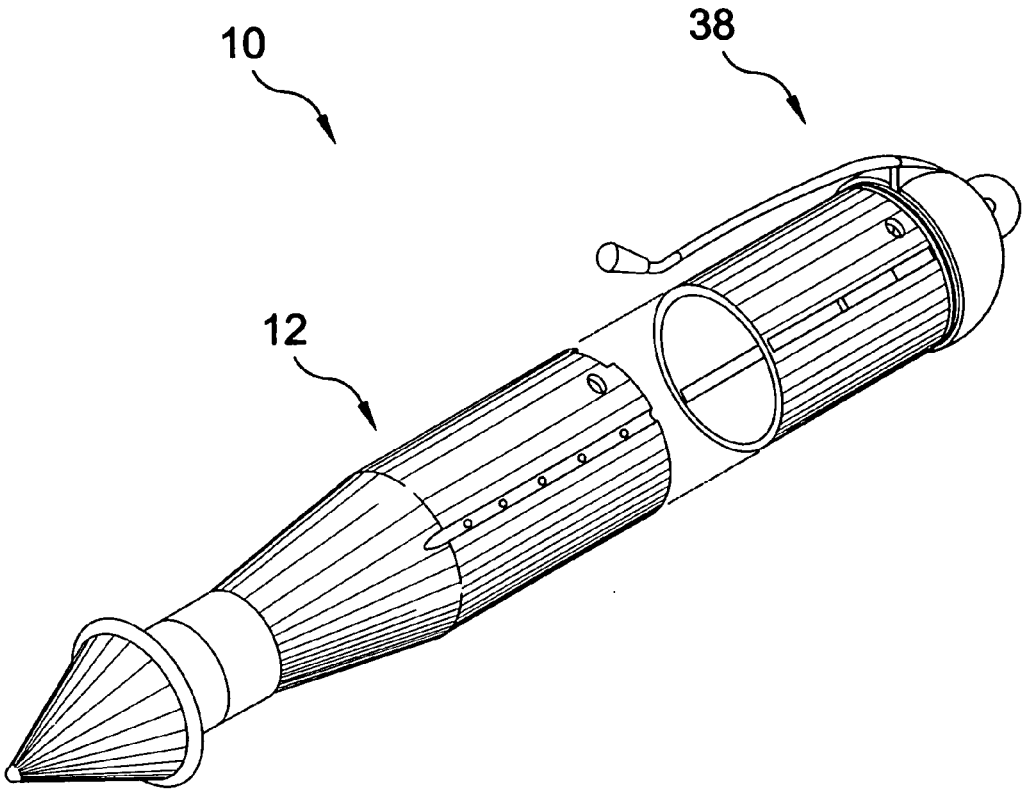
FIG. 15 is a perspective view of an additional design of the present invention.

FIG. 15 is a perspective view of an additional design of the present invention 10. This design enables the device to dispense a powdery substance (i.e. rosin, cornstarch, talc ect.) that a player might use to prevent moisture from building up on their hands, which may cause a slippery racquet grip from developing during play. Shown are the handle body 12 and the rotating cap member 38.

Figure 16:
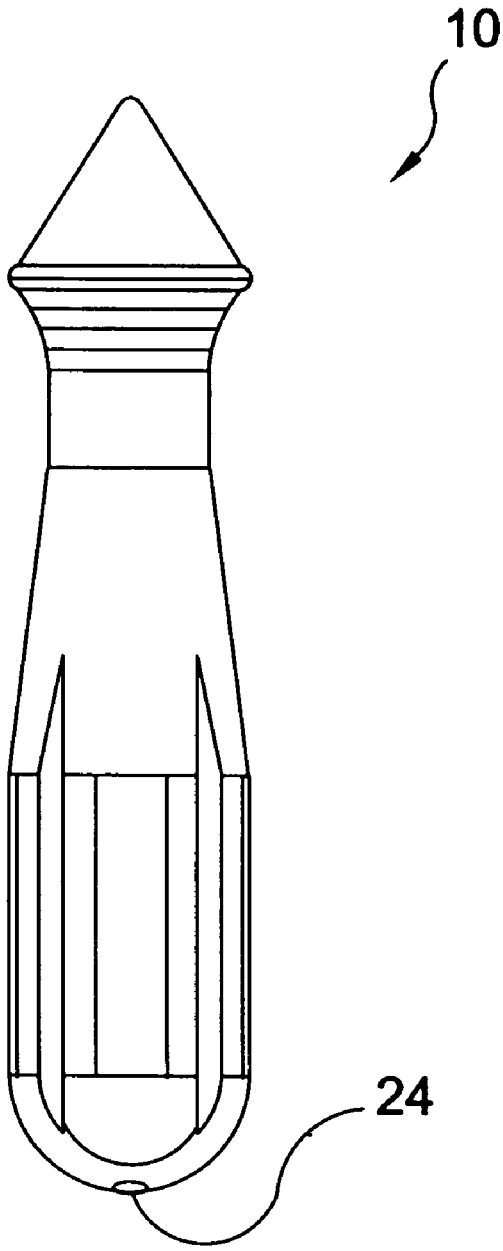
FIG. 16 is an orthographic view of the present invention (clip omitted).

FIG. 16 is an orthographic view of the present invention 10 (clip omitted). Shown is an orthographic view of the present invention 10 not having a clip but having a retractable cord aperture 24.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A racquet-string alignment pick comprising:

a) a handle body having a first end and a second end;

b) a conical spacer head disposed on said second end of said handle body wherein the widest diameter of said spacer head is substantially equivalent to the preferred distance between strings of the racquet to be aligned;

c) a stop member disposed between said second end of said handle body and the widest point of said spacer head extending circumferentially therefrom; and d) means for dispensing a powdery substance comprising:

i) an open second end of said handle body providing access to a substantially hollow interior chamber;

ii) an elongate insert member depending from a rotatable cap member that is inserted into said hollow interior chamber and is then permanently retained therein in a rotatable fashion;

iii) a niche disposed in said interior chamber proximal said open end of said second handle end and a smaller tab disposed on said cap member configured to have said tab reside within said niche to restrict the rotation of said rotatable cap and its related insert member;

iv) an inner fill hole aperture disposed in said insert member and a corresponding outer fill hole aperture disposed in said handle body; and v) a plurality of open slots extending substantially along the length of said insert member and a plurality of rows of perforations disposed in grooves corresponding with said open slots.

2. A racquet-string alignment pick as recited in claim 1, wherein said second end of said handle body tapers to a narrower cross sectional than said first end and said stop member to provide a finger grip for greater ergonomic properties during use.

3. A racquet-string alignment pick as recited in claim 2, wherein the tip of said spacer head is introduced into the gap between misaligned strings of a racquet and pushed therein until said stop member contacts the strings thereby separating the gap between the strings to the desired distance due to the diameter of the base of said spacer head adjacent to said stop member being substantially equivalent to said desired gap.

4. A racquet-string alignment pick as recited in claim 3, wherein proper alignment of displaced strings can still be achieved if the user fails to fully insert said spacer head until said stop member contacts said strings because the pre-existing tension built into said strings when the racquet undergoes the stringing process frequently serves to realign said strings once released by said spacer head.

5. A racquet-string alignment pick as recited in claim 4, further includes means for attaching said alignment pick to an article of clothing.

6. A racquet-string alignment pick as recited in claim 5, wherein said clothing attachment means is a clip depending from said handle body.

7. A racquet-string alignment pick as recited in claim 6, wherein said handle body further comprises an aperture on said first end of said handle body for connecting a retractable cord thereto.

8. A racquet-string alignment pick as recited in claim 6, wherein said handle body further includes an eyelet for connecting accessory items thereto.

9. A racquet-string alignment pick as recited in claim 8, wherein said handle body includes an interior storage chamber comprising:

a) a substantially hollow interior chamber accessible from said second end of said handle body;

b) female threads disposed within said hollow interior chamber; and c) male threads extending from the handle-oriented portion of said spacer head thereby effectively forming a removable cap.

10. A racquet-string alignment pick as recited in claim 8, wherein said handle body includes an interior storage chamber comprising:

a) a substantially hollow interior accessible from said second end of said handle body; and b) a flip-top cap secured to said second end of said handle body to provide a permanently affixed cap member that allows for quick and easy access to said interior storage chamber.

11. A racquet-string alignment pick as recited in claim 1, wherein said fill hole apertures are not in alignment with one another when said perforations and said open slots are in alignment.

12. A racquet-string alignment pick as recited in claim 11, wherein said powdery substance is introduced into said hollow interior chamber by rotating said cap until said fill hole apertures are aligned with one another and inserting said powdery substance therethrough.

13. A racquet-string alignment pick as recited in claim 12, wherein said powdery substance is dispensed by rotating said cap until said perforations are aligned with said open slots and agitating said handle body.

14. A racquet-string alignment pick as recited in claim 13, wherein said handle body is placed into a closed position by rotating said cap until neither said fill hole apertures and said perforations and said open slots are in alignment.

15. A racquet-string alignment pick as recited in claim 14, further comprising an eyelet extending from said cap to provide a finger grip to aid in the precise rotation of said cap as well as to provide a means for attaching accessory items thereto.

16. A racquet-string alignment pick as recited in claim 15, further comprising indicia disposed on said handle body to designate the status of the rotational cap indicating if it is in the fill, open or closed position with said clip aligning with said indicia accordingly.

* * * * *